US011554303B2

(12) United States Patent
Osthus

(10) Patent No.: US 11,554,303 B2
(45) Date of Patent: Jan. 17, 2023

(54) OUTDOOR FLYING RING THREE GAME BOARD SET

(71) Applicant: Leif Osthus, Marysville, WA (US)

(72) Inventor: Leif Osthus, Marysville, WA (US)

( * ) Notice: Subject to any disclaimer, the term of this patent is extended or adjusted under 35 U.S.C. 154(b) by 303 days.

(21) Appl. No.: 16/911,614

(22) Filed: Jun. 25, 2020

(65) Prior Publication Data

US 2021/0402272 A1 Dec. 30, 2021

(51) Int. Cl.
*A63B 67/06* (2006.01)

(52) U.S. Cl.
CPC ..... *A63B 67/06* (2013.01); *A63B 2067/061* (2013.01); *A63B 2067/063* (2013.01); *A63B 2225/74* (2020.08)

(58) Field of Classification Search
CPC ..... A63B 67/06; A63B 2067/063; A63B 2071/0625; A63B 2225/74; A63B 2067/061
See application file for complete search history.

(56) References Cited

U.S. PATENT DOCUMENTS 163,845 A * 6/1875 Browne ..... A63B 67/06 273/338
2,538,128 A * 1/1951 Simmons ..... A63F 9/0208 273/339
3,823,942 A * 7/1974 Duncan ..... A63B 65/12 273/338
4,180,266 A * 12/1979 Morin ..... A63B 67/06 273/338
4,203,592 A * 5/1980 Quatkemeyer ..... A63B 67/06 273/398
4,726,591 A * 2/1988 Johnson ..... A63B 67/06 273/338
4,898,392 A * 2/1990 Goletz ..... A63B 63/08 273/123 R
4,966,373 A * 10/1990 Houle ..... A63B 67/06 273/338
4,982,966 A * 1/1991 Teafatiller ..... A63B 67/06 273/338

(Continued)

FOREIGN PATENT DOCUMENTS

CA 2402090 A1 * 5/2003 ..... A63B 67/06
GB 190923565 A * 10/1909 ..... A63B 63/007
WO WO-2011011770 A1 * 1/2011 ..... A63B 63/007

*Primary Examiner* — Raleigh W Chiu
(74) *Attorney, Agent, or Firm* — Lyman Moulton; Moulton Patents, PLLC

(57) ABSTRACT

The disclosed flying ring game includes a flying ring and a rectangular game board having two opposing short ends and two lateral sides, wherein the rectangular game board is disposed at a ten degree angle from a flat reference and defines a circular opening proximal a short end. The flying ring game also comprises a light stick and base adjacent a middle of each of the opposing short ends and the lateral sides. Each light stick is mounted to an interconnecting base and has a rubber ball at its top and a light source adjacent the light stick. The flying ring game also includes a stand alone light stick having a circular base and a rubber ball at its top. A method of playing the disclosed flying ring game with multiple game boards and multiple interconnected light sticks and multiple stand alone light sticks is also included in the disclosure.

14 Claims, 5 Drawing Sheets

(56) References Cited

U.S. PATENT DOCUMENTS 5,230,650 A * 7/1993 Brayton ..... F42B 12/362 473/576
5,873,573 A * 2/1999 Beatty, Jr. ..... A63B 67/06 273/336
5,938,202 A * 8/1999 Williams ..... A63B 67/06 273/336
6,669,200 B1 * 12/2003 Knetsch ..... A63B 67/06 273/400
7,134,662 B2 * 11/2006 Menendez ..... A63B 67/06 273/400
8,807,569 B1 * 8/2014 Davis ..... F41J 5/20 473/570
8,915,498 B2 * 12/2014 Hynds ..... A63B 67/06 273/354
10,544,934 B1 * 1/2020 Kennedy ..... F21V 33/008
10,835,794 B1 * 11/2020 McMahon ..... G01B 5/14
10,974,114 B2 * 4/2021 Kwiatek ..... A63B 71/023
11,173,363 B1 * 11/2021 Pontrelli ..... A63B 63/08
2002/0175469 A1 * 11/2002 Kessler, Jr. ..... A63B 67/06 273/400
2006/0097454 A1 * 5/2006 Mattson ..... A63B 71/02 273/338
2010/0176554 A1 * 7/2010 Godwin ..... A63B 67/06 273/338
2011/0037226 A1 * 2/2011 Nickles ..... A63B 67/06 273/343
2015/0054221 A1 * 2/2015 Sandman ..... A63B 60/16 273/402
2015/0115531 A1 * 4/2015 Ali ..... A63F 9/02 273/398
2015/0231467 A1 * 8/2015 Sciandra ..... A63B 67/06 273/402
2016/0023095 A1 * 1/2016 Nally ..... A63F 9/0208 273/343
2016/0121186 A1 * 5/2016 Sciandra ..... A63B 67/007 273/350
2017/0113112 A1 * 4/2017 Voss ..... A63B 67/06
2017/0138586 A1 * 5/2017 Finch ..... A63B 67/06
2018/0049553 A1 * 2/2018 Fecher ..... A63B 67/002
2018/0085649 A1 * 3/2018 O'Neill ..... A63B 67/06
2020/0047060 A1 * 2/2020 Bauer ..... A63F 7/0668
2020/0360783 A1 * 11/2020 Rause ..... A63B 67/06
2020/0391095 A1 * 12/2020 Michael ..... A63B 67/06
2021/0402272 A1 * 12/2021 Osthus ..... A63B 67/06
2022/0096909 A1 * 3/2022 Russell ..... H05B 47/115
2022/0143480 A1 * 5/2022 Lieb ..... A63B 67/06
2022/0161112 A1 * 5/2022 Bierman ..... A63B 71/023

* cited by examiner

OUTDOOR FLYING RING THREE GAME BOARD SET

BACKGROUND OF THE INVENTION

In the 1970s, Alan Adler began attempting to improve the flying disc, considering its design characteristics. He tried streamlining the shape to reduce drag, but this resulted in a disc that was more unstable in flight. Eventually, inspired by British accounts of deadly Indian weaponry and martial arts, he turned his attention to the ring shape of the Chakram, a formidable Punjabi weapon used by the Sikh of India. This led to the development of the predecessor of the Aerobie, which was called the "Skyro". About a million of this model were sold. In 1980, it was used to set a Guinness World Record throw of 261 metres (856 ft). It lacked the spoiler rim of the Aerobie. It had low drag but was stable at only a certain speed. The later introduction of the spoiler, which balanced the lift, made the ring stable "over a wide range of speeds".[6] After testing several models, the ideal shape was found, and the Aerobie was produced. Adler founded Superflight, Inc. (now known as Aerobie, Inc.) in 1984. Since then, Adler and the company have produced 12 other sport toy products.

SUMMARY OF THE DISCLOSURE

A disclosed flying ring game comprises a flying ring and a rectangular game board having 2 opposing short ends and 2 lateral sides, wherein the rectangular game board is disposed at a ten degree angle from a flat reference and defines a circular opening proximal a short end. The flying ring game also comprises a light stick and base adjacent a middle of each of the opposing short ends and the lateral sides. Each light stick is mounted to an interconnecting base and has a rubber ball at its top and a light source adjacent the light stick. The flying ring game also includes a stand alone light stick having a circular base and a rubber ball at its top and a light source adjacent the light stick.

BRIEF DESCRIPTION OF DRAWINGS

FIG. 2-*b* depicts a sticks base component in accordance with an embodiment of the disclosure.

DETAILED DESCRIPTION

The present invention is a an outdoor game board and sticks base comprising three parts that may be combined or separated for game play of three games each using an aerobie disc or discs.

The term 'ring,' used throughout the present disclosure refers to a hollow center throwing disc. Therefore, the terms 'ring' and 'disc' can be used interchangeably throughout the disclosure. The term 'light stick,' refers to a lighted 'pole,' and other thin diameter cylindrical and sometimes hollow 'rods.'

Figure 1:
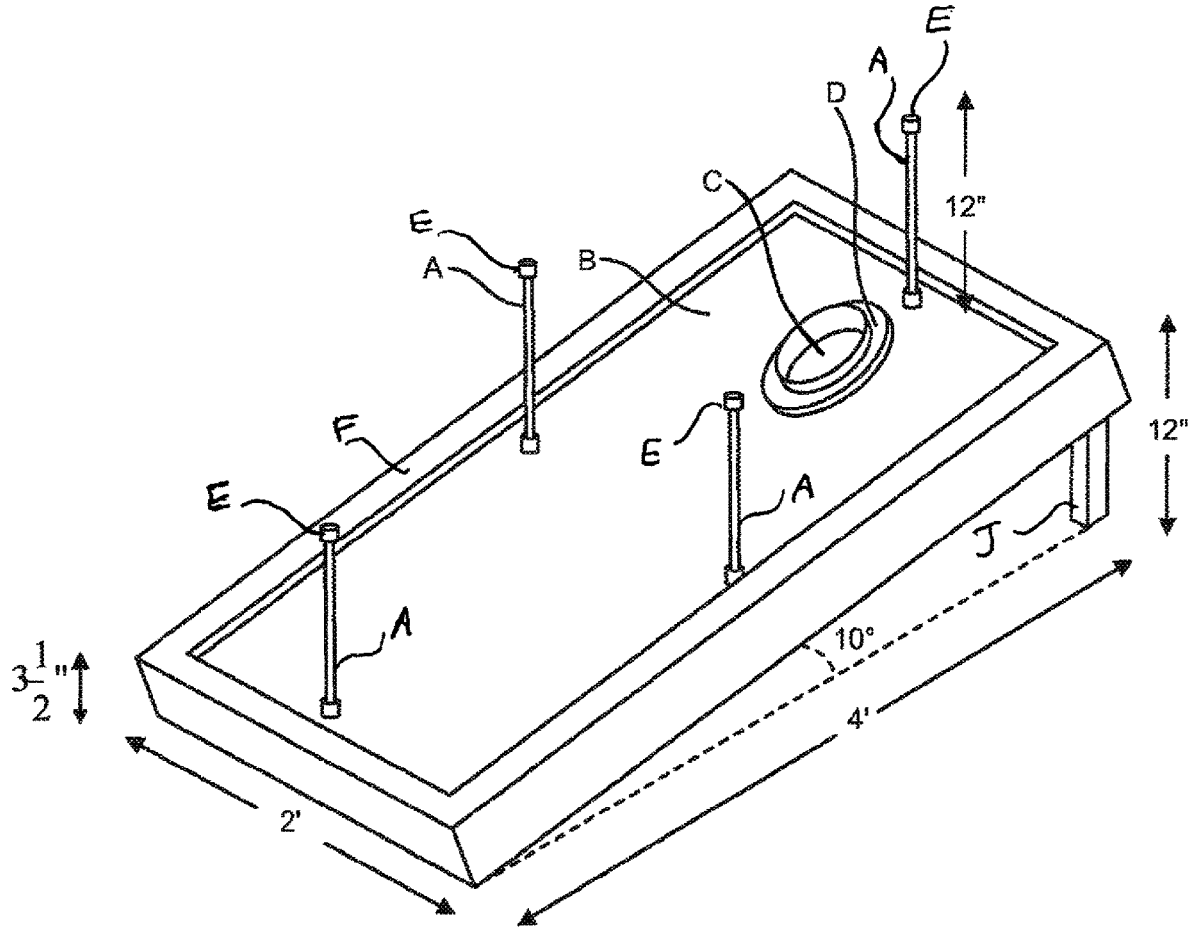
FIG. 1 depicts a slanted board base similar to a cornhole board in accordance with an embodiment of the disclosure.

FIG. 1 depicts a board base to a cornhole board in accordance with an embodiment of the disclosure. The board base B, also known as the board B is 12 inches tall at one end and 3.5 inches tall at the other end. The board is two feet wide and four feet long. The board sits at a 10 degree upward angle supported by the prop J. There are four light sticks A with light sources E and of varying height that protrude at four separate points at right angles from the surface of the board B. At the upper end of the board there is a circular hole C 6 inches in diameter, such seen in cornhole boards. Also depicted is grommet D around the perimeter of circular hole C. Frame F supports and decorates the board B.

Figure 2A:
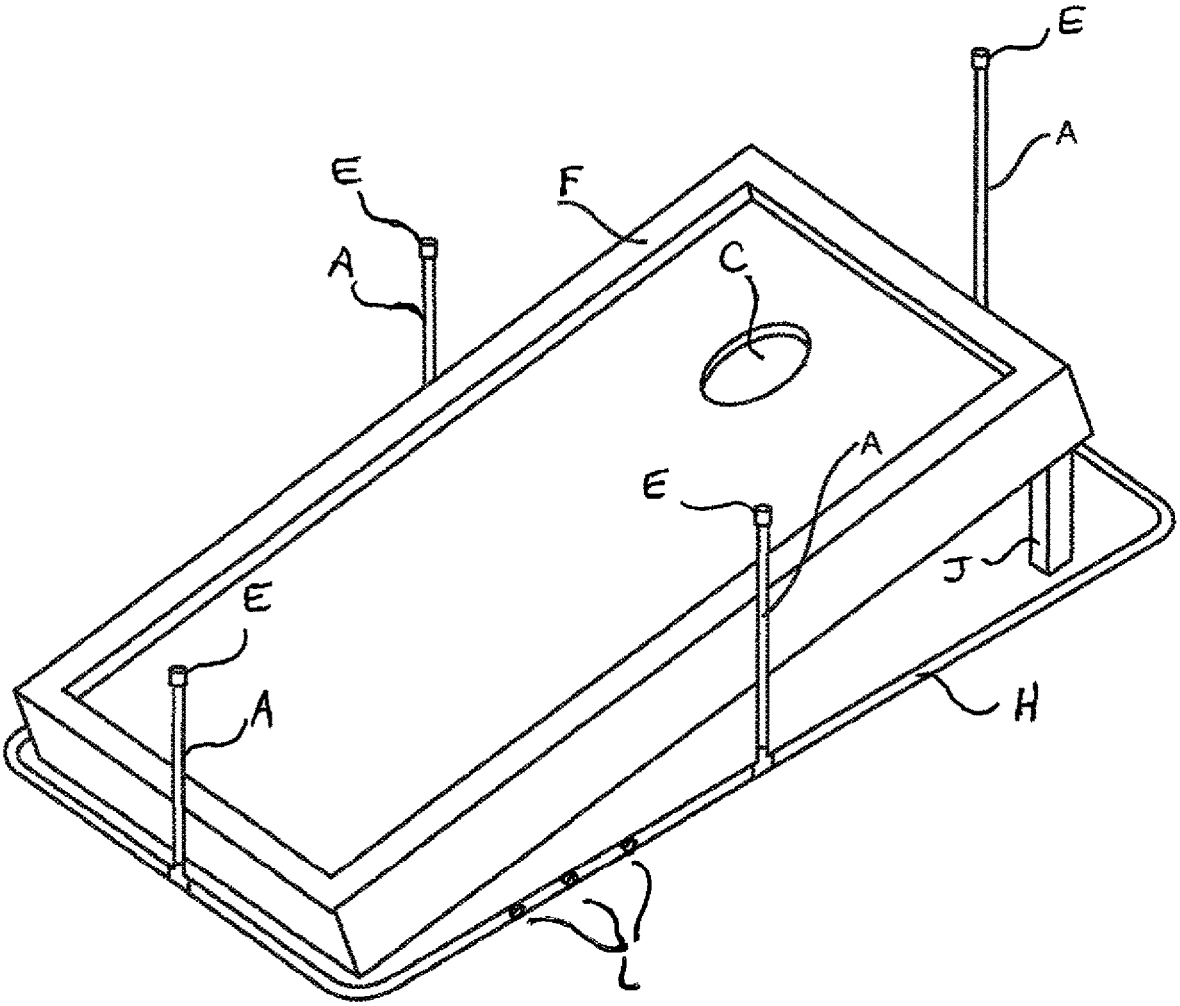
FIG. 2-*a* depicts two components combined for game play, namely a slanted board base and a sticks base in accordance with an embodiment of the disclosure.
Figure 2B:
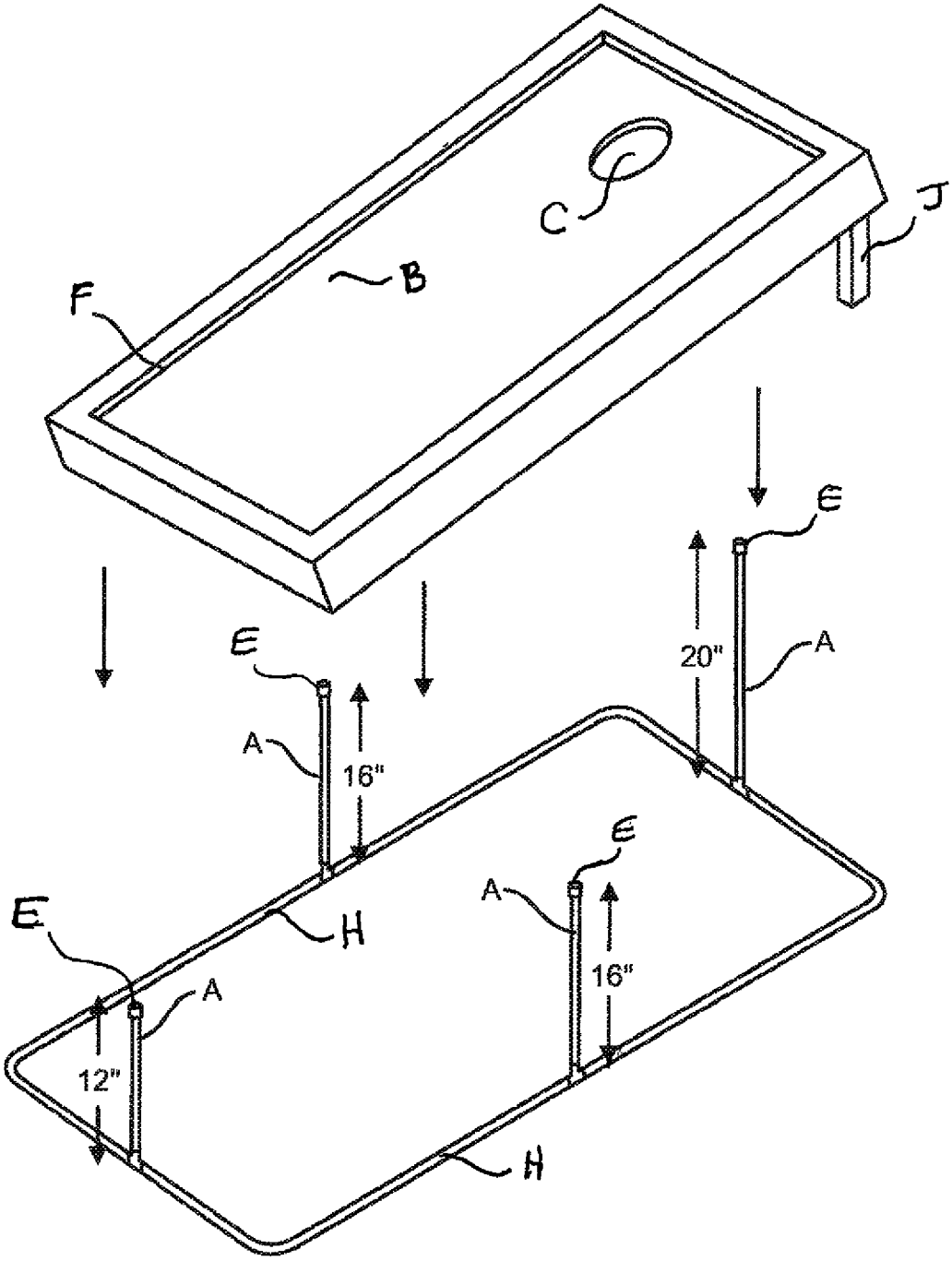

FIG. 2-*a* depicts a cornhole board and a sticks base that fits around the cornhole board. The sticks base H comprises one rectangular base that rests on the ground from which four poles or light sticks A and light sources E adjacent thereto which protrude at right angles, one on length of the rectangle. Poles vary in size with the tallest pole behind the tallest end of the cornhole board. Also depicted are LED (light emitting diodes) L in the sticks base H. Same reference letters are depicted as in other drawings to similar and same limitations.

FIG. 2-*b* depicts a sticks base component. The component comprises one rectangular base that rests on the ground from which four poles or sticks protrude at right angles at different sides of the rectangle. Poles vary in size with the tallest pole opposite the shortest pole.

A cornhole (also known as dummy boards, bean bag toss, dadhole, doghouse, Baggo or Bags) is an American lawn game in which players take turns throwing bags of corn (or bean bags) at a raised platform with a hole in the far end. A bag in the hole scores 3 points, while one on the platform scores 1 point.

Figure 3:
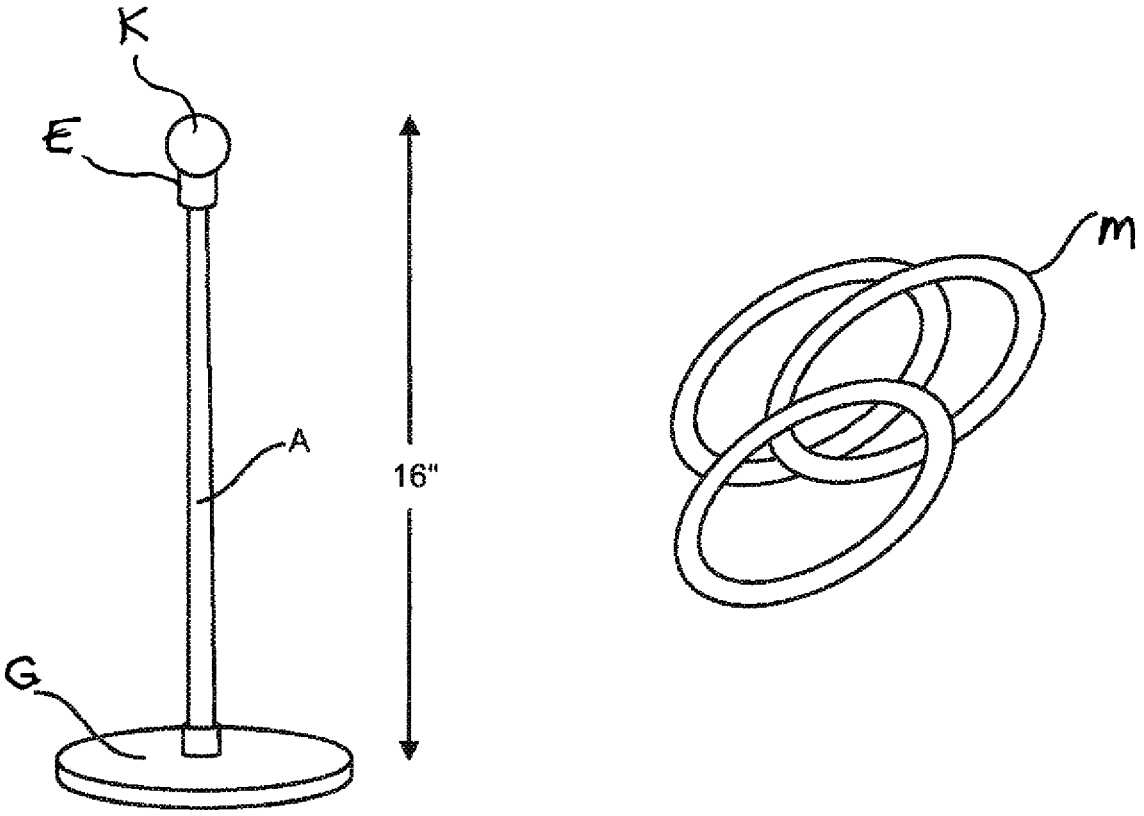
FIG. 3 depicts a single stick component in accordance with an embodiment of the present disclosure.

FIG. 3 depicts a single stick component. The component includes a 6 inch diameter base G with one 16 inch tall light stick A protruding at a right angle from the center of the base G containing one 1.5 inch sphere or rubber ball K at the top of the light stick. Same reference letters are depicted as in other drawings to same and similar limitations. Flying rings M are also depicted in a group of three and are configured to be tossed around one of the light sticks A or through the circular opening C.

Game play utilizes a scoring system similar to golf in that players try to throw the disc on the stick in the least number of throws. If a player lands the aerobie disc at the base of the stick to enter the perimeter of the throwing disc. The result is minus a stroke. Component can be moved after each round is played. Players may vary their starting point distance from the component.

Figure 4:
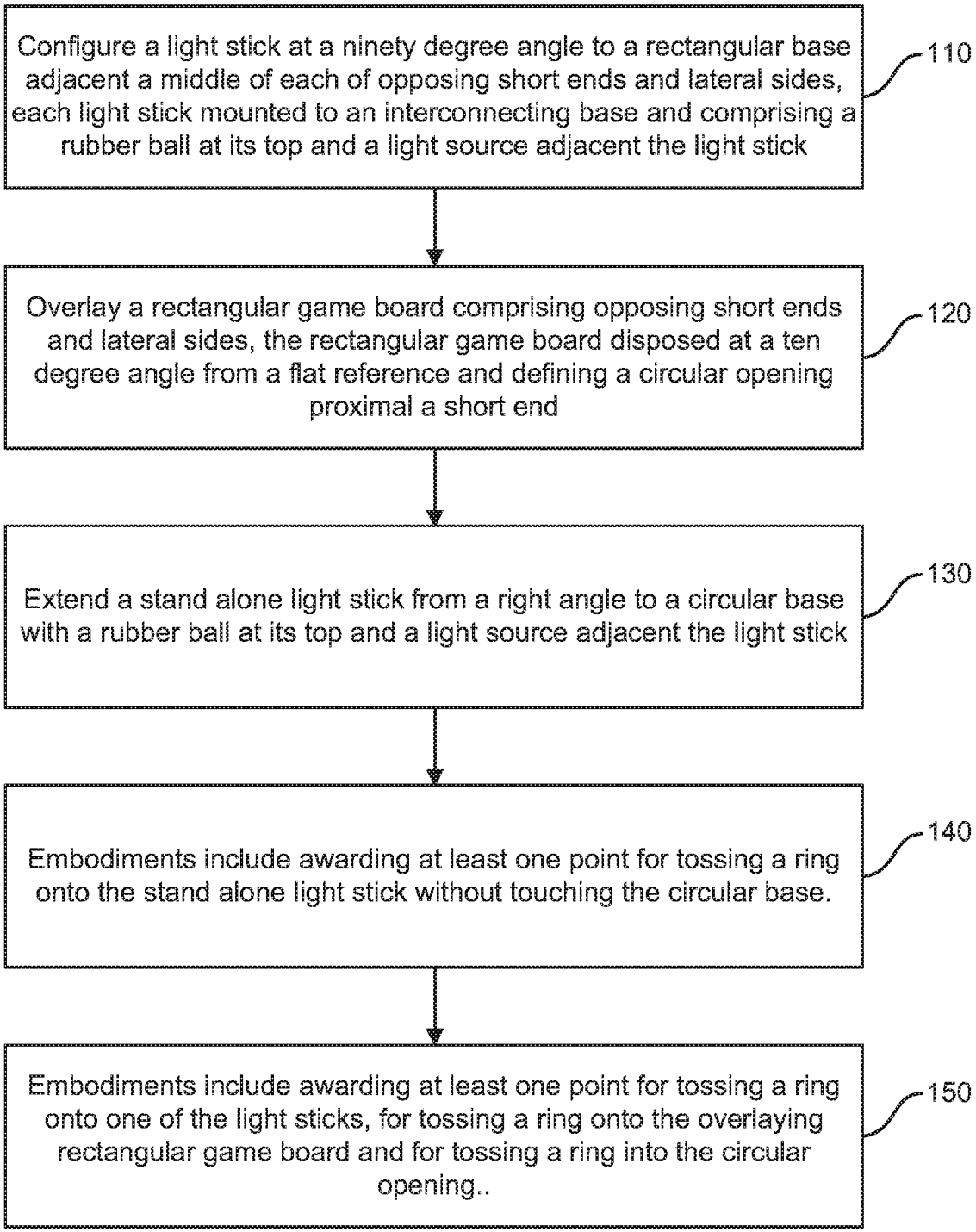
FIG. 4 depicts a flow chart of a method for playing the flying ring game in accordance with an embodiment of the disclosure.

FIG. 4 depicts a flow chart of a method for playing the flying ring game in accordance with an embodiment of the disclosure. The method includes configuring 110 a light stick at a ninety degree angle to a rectangular base adjacent a middle of each of opposing short ends and lateral sides, each light stick mounted to an interconnecting base and comprising a rubber ball at its top and a light source adjacent the light stick. The method also includes overlaying 120 a rectangular game board comprising opposing short ends and lateral sides, the rectangular game board disposed at a ten degree angle from a flat reference and defining a circular opening proximal a short end. The method further includes extending 130 a stand alone light stick from a right angle to a circular base with a rubber ball at its top and a light source adjacent the light stick. Embodiments of the disclosed method include awarding at least one point 140 for tossing a ring onto the stand alone light stick without touching the circular base. Further embodiments of the method include awarding 150 at least one point for tossing a ring onto one of the light sticks, tossing a ring onto the overlaying rectangular game board and for tossing a ring into the circular opening.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. A flying ring game comprising a flying ring and comprising:

a. a rectangular game board comprising 2 opposing short ends and 2 lateral sides, the rectangular game board disposed at a ten degree angle from a flat reference and defining a circular opening proximal a short end; and b. a light stick and base adjacent a middle of each of the opposing short ends and the lateral sides, each light stick mounted to a base and comprising a rubber ball at its top and a light source adjacent the light stick, wherein the flying ring is tossed around one of the light sticks or through the circular opening.

2. The flying ring game of claim 1, wherein a height of a first short end light stick is shorter than a height of the two lateral side light sticks which are shorter than a height of a second elevated short end light stick taller than all other 3 light sticks.

3. The flying ring game of claim 1, wherein a height of a first short end light stick is 12 inches, a height of the lateral side light sticks is 16 inches and a height of an elevated short end light stick is 20 inches.

4. The flying ring game of claim 1, further comprising a fifth light stick having a circular base with an outer circumference less than an inner circumference of the flying ring.

5. The flying ring game of claim 1, further comprising a circular speaker disposed on a circumference of the circular opening.

6. The flying ring game of claim 1, wherein the opposing short ends are a nominal 2 feet in length and the lateral sides are a nominal 4 feet in length.

7. The flying ring game of claim 1, further comprising an array of light emitting diodes (LED) which flash to music under a translucent and mirror-like surface on the rectangular game board.

8. The flying ring game of claim 1, further comprising a fifth light stick having a circular base circumference of a nominal 6.5 inches versus an inner circumference of the flying ring at a nominal 10.5 inches.

9. The flying ring game of claim 1, further comprising a common interconnecting base for the short end light sticks and the lateral light sticks.

10. A flying ring game comprising a flying ring and comprising:

a. a rectangular game board comprising 2 opposing short ends and 2 lateral sides, the rectangular game board disposed at a ten degree angle from a flat reference and defining a circular opening proximal a short end; and b. a light stick and base adjacent a middle of each of the opposing short ends and the lateral sides, each light stick mounted to an interconnecting base and comprising a rubber ball at its top and a light source adjacent the light stick; and c. a stand alone light stick having a circular base and a rubber ball at its top and a light source adjacent the light stick, wherein the flying ring is tossed around one of the light sticks or the stand alone light stick or through the circular opening.

11. The flying ring game of claim 10, wherein a height of the stand alone light stick is a nominal 16 inches at a right angle to the circular base.

12. The flying ring game of claim 10, wherein the interconnecting base comprises a tubular rectangular frame having a geometry and size similar to a geometry and size of the rectangular game board.

13. The flying ring game of claim 10, wherein the rectangular frame game board is configured as an overlay for the interconnecting base.

14. The flying ring game of claim 10, further comprising a plurality of rectangular game boards, a plurality of light sticks and interconnecting bases and a plurality of stand alone light sticks and bases.

* * * * *